United States Patent [19]

Hornung

[11] 4,059,034

[45] Nov. 22, 1977

[54] SCREW-DRIVING DEVICES

[75] Inventor: Ewald Hornung, Rinteln, Germany

[73] Assignee: Feinwerkbau Helfer & Co. KG, Mollenbeck, Germany

[21] Appl. No.: 707,959

[22] Filed: July 23, 1976

[30] Foreign Application Priority Data

Sept. 15, 1975 Germany ..... 2541046

[51] Int. Cl.[2] ..... B25B 23/02
[52] U.S. Cl. ..... 81/57.37
[58] Field of Search ..... 81/57.37

[56] References Cited

U.S. PATENT DOCUMENTS

| | | | |
|---|---|---|---|
| 3,910,324 | 10/1975 | Nasiatka | 144/32 |
| 3,930,297 | 1/1976 | Potucek et al. | 144/32 |

FOREIGN PATENT DOCUMENTS

| | | | |
|---|---|---|---|
| 2,404,990 | 2/1974 | Germany | 144/32 |

*Primary Examiner*—James L. Jones, Jr.
*Attorney, Agent, or Firm*—Larson, Taylor & Hinds

[57] ABSTRACT

A screw-driving device includes a casing having a slide member which in turn supports an indexing arrangement for indexing a flexible belt carrying a plurality of screws, the indexing arrangement serving to index a screw into a screwing station whenever the device is operated. The index arrangement includes sprocket discs the teeth of which engage the notched belt and movement of the indexing device to index the belt through one pitch is controlled by a coupling movable under the control of a pin slidable in an elongate aperture or recess in the casing of the device.

A plurality of springs is employed to return the slide member to its inoperative condition at the end of each working cycle.

9 Claims, 5 Drawing Figures

SCREW-DRIVING DEVICES

BACKGROUND OF THE INVENTION

1. Field of the Invention

This invention relates to screw-driving devices.

2. Summary of the Prior Art

Devices have been proposed for driving screws into a workpiece such devices incorporating a screw magazine, a screwdriver which can be connected by a coupling with the drive of the device and arranged in a housing, and means for indexing the screws into a screwdriving station have been proposed, the indexing means being mounted in a slide member which is movably mounted in a casing of the device against a spring force. Such devices have been proposed in various forms. They all have the disadvantage that the indexing of the screws in the magazine to the screwdriving station is effected by using the energy of pre-loaded springs. As a result of relieving and as a result of the distortions caused by the fatigue effect springs of differing characteristics are produced so that trouble-free operation of the device is unlikely and indexing from the magazine is consequently not effected at all or is only effected imperfectly.

An object of the present invention is therefore to overcome the difficulties arising through the deformation of the springs in the known devices which will ensure trouble-free indexing under all conditions.

SUMMARY OF THE INVENTION

According to the present invention there is provided a device for driving screws, means defining a screw-holding magazine, a casing, a screw-driving member mounted for rotation in the casing, drive means, coupling means for coupling said drive means to the screw-driving member, means for indexing successive screws from the magazine into a screw-driving station in which each successive screw is aligned with the screw-driving member, a slide member slidable in the casing and carrying the indexing means, means operable by exertion of a force between the slide member and a workpiece about to receive a screw, to actuate the indexing means and thus index a screw in the magazine to the screw-driving station, and resilient means effective to resist said force exerted between the slide member and the workpiece.

Further according to the present invention there is provided a screw-driving device comprising means defining a screw-holding magazine in the form of an apertured, edgewise notched belt, a casing, a slide member slidable in the casing and carrying means for indexing successive screws held in the magazine to a station at which the screws can be driven into a workpiece, said indexing means including a sprocket member having sprocket teeth arranged to engage the notches of the magazine belt, a drive coupling, means defined by the casing for controlling the coupling in response to relative sliding motion between the slide member and the casing to index the belt, and means operative on the sprocket member to permit movement thereof in the indexing direction and prevent movement in the opposite sense, a screw-driving member, a drive mounted on the casing and connectable to the screw-driving member to rotate it and drive a screw at the screw-driving station, and resilient means biasing the slide member to an inoperative condition, the device being operated by movement of the slide member relative to the casing from said inoperative condition.

By means of the proposed device in accordance with the invention there is thus provided positive indexing of screws to a screwing station, only when the slide member is pressed against the workpiece.

In a preferred embodiment, the screw magazine is in the form of a screw-carrying belt, the indexing means is a sprocket member, of which one sprocket disc forms part of a releasable coupling; a second coupling disc of the coupling mounting a pin which co-operates with a guide slot so arranged in the casing that by movement of the pin along this guide slot, the sprocket member is turned through one index step.

Preferably apertures are provided in the sprocket disc serving as the coupling disc, which in the coupled condition engage projections mounted on the other coupling disc and the coupling disc is under the bias of a spring, which on the return movement of the slide member facilitates, in the starting position, a rapid release of the coupling.

Preferably the arcuate movement of the pin about the central axis of the coupling disc is limited by two end stops. Both end stops are formed by a slot in a plate of the slide member through which the pin passes.

A pawl may be mounted in the slide member, which permits rotational movement only in the indexing direction of the sprocket member, but prevents motion in the opposite direction. The pawl is preferably subject to the action of a spring-loaded member, such as a pin.

An adjustable pin is provided in the casing, which the slide member engages after completion of the screwing process and by this means the coupling between the screwdriver and the drive shaft of the drive is released.

The device in accordance with the invention omits elements which are subject to fatigue effects or have characteristics which change during the course of use of the device as is the case for springs, upon which indexing of the screws to the screwing station depends.

DESCRIPTION OF THE PREFERRED EMBODIMENT

A drive for a device in accordance with the invention is denoted generally by the reference 1 and is illustrated only partially for the sake of clarity. The drive has a drive shaft driven, for example, by an electric motor, which can be connected to the shaft through a releasable coupling, likewise not illustrated. The coupling may be a dog clutch one part of which is connected to a screwdriver 2 which is mounted within a casing 3.

Figure 1:
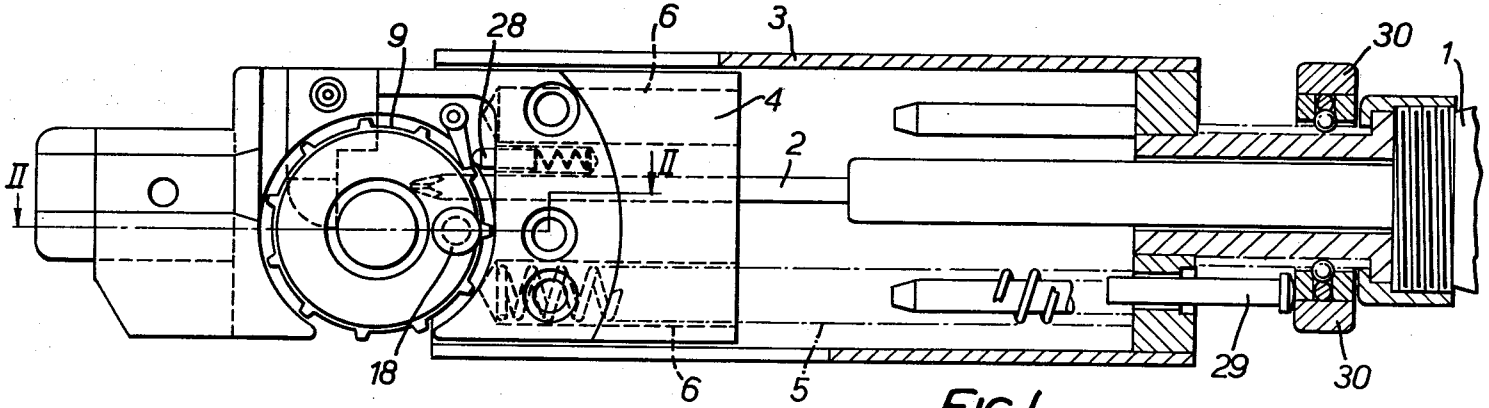
FIG. 1 is a longitudinal part-sectional view of a screw-driving device in accordance with the invention.
Figure 2:
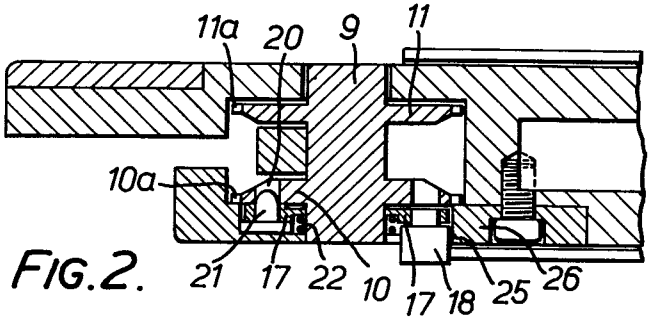
FIG. 2 is a section on line II—II of FIG. 1.
Figure 5:
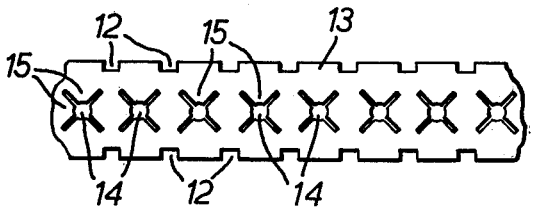
FIG. 5 is a plan view of a fragment of the screw-carrying belt of FIG. 4.

A slide member 4 is mounted in an end portion of the casing 2 and is biased by springs 5, which engage in corresponding recesses 6 in the slide member 4, to the left as shown in FIG. 1 of the drawing. A device for indexing the screws to a driving station is mounted in the slide member 4. This indexing device includes a sprocket member 9 having two sprocket discs 10, 11 and is rotatably mounted in the slide member 4. The sprocket teeth 10*a*, 11*a* engage in notches 12 of a screw belt 13 (FIG. 5), in a manner similar to engagement of a film with the transport roll of a camera. Tabs 15 are formed around each opening 14 of the belt 13 which engage the head portion 7*a* of an inserted screw 7. The belt 13 consists preferably of a resilient synthetic-resin.

At the front end of the slide member 4 a frusto-conical recess 16 is provided, which leads into a hollow cylindrical recess 8. The screws engage in the recesses 16, 8 before they are driven into a receiving workpiece.

Figure 3:
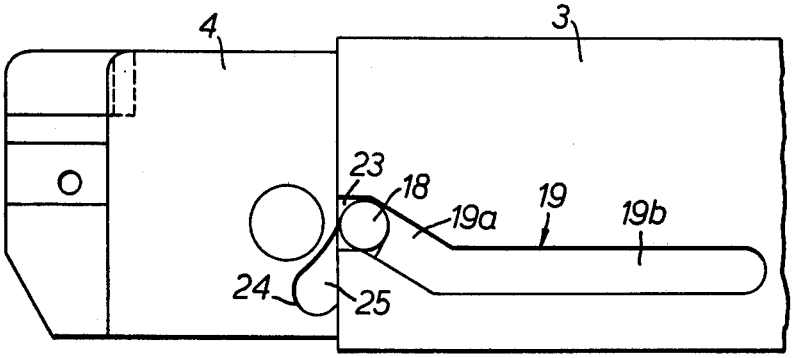
FIG. 3 is a view of a part of a casing of the device and of a slide member displaceably mounted therein.

The sprocket disc 10 forms a part of a releasable coupling, the other coupling disc of which is denoted by the reference 17. A pin 18 is mounted on the coupling disc 17 which is engageable in a guide slot 19 of the casing 3. This guide slot 19 has the form illustrated in FIG. 3 of the drawing. It consists of a short portion 19*a* inclined to the longitudinal axis of the device as a whole which leads into a part 19*a* extending axially of the device as a whole.

Apertures 20 are provided in the sprocket disc 10, the centre points of which are spaced around a circle. In the coupled condition, projections or pins 21 engage in these apertures 20, which are mounted on the coupling disc 17. The coupling disc 17 is subject to the action of a spring 22 which on the return movement of the slide member 4 facilitates rapid release of the coupling to cause a return to the starting position.

The arcuate motion of the pin 18 about the centre point of the coupling disc 17 is limited by two stops 23, 24 (FIG. 3) defined by ends of a slot 25 which is provided in a plate 26 secured to the slide member 4.

A pawl 27 (FIG. 4) is mounted on the slide member 4, which permits rotational movement of the sprocket member 9 in the positive indexing direction, but prevents rotation in the opposite direction. This pawl 27 is biased by a spring-loaded member, for example, a spring-loaded pin 28 to ensure that reverse rotation is prevented.

An adjustable pin 29 is mounted in an end wall of the casing 3, which is engaged by the slide member 4 after completion of a screw-driving operation and serves to release the coupling between the screwdriver 2 and the drive shaft of the drive 1. Adjustment of the pin 29 is effected by an adjustment ring 30.

Figure 4:
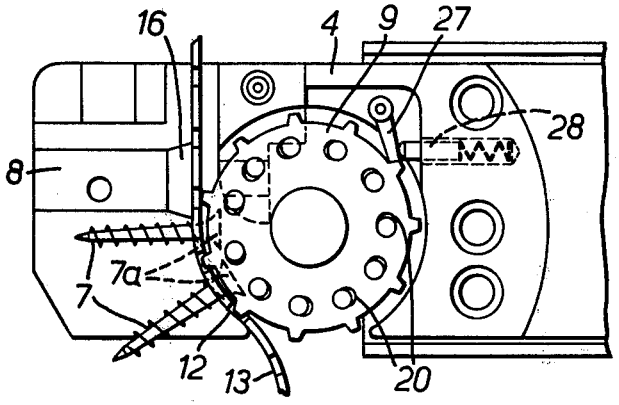
FIG. 4 is a fragmentary view, partly in section showing a part of the device with a screw-carrying belt in situ.

The manner of operation of the hereinbefore described apparatus is as follows:

Initially the screw belt 13, filled with screws, is inserted into the slide member 4, as is indicated in FIG. 4 of the drawing so that the sprockets 10*a*, 11*a* of the sprocket member 9 engage in the corresponding notches 12 of the screw-carrying belt 13.

By pressing the front end of the slide member 4 against the workpiece (not shown in the drawing) the slide member 4 moves to the right as illustrated in FIG. 1 against the force of the springs 5. During this movement, the pin 18 engages in the guide slot 19, and initially moves along the part 19*a*. As a result of this positive movement the pin 18, and thus the coupling disc connected thereto, rotates in the clockwise sense until the pin 18 abuts against the end stop 24. By this rotational movement, the coupling disc 17 is further rotated over the projections 21 engaging in the apertures 20, and the sprocket disc 10 and thus also the sprocket member 9 as such are indexed through a further step, the slot 25 being so dimensioned that movement is effected only over a single indexing step.

In this way the screws are moved successively into the recesses 8, 16 in which position they are aligned with the screwdriver 2. One screw 7 has now reached the screwing station.

After completion of this indexing step the pin 18 moves in the axial part 19*b* of the guide slot 19 so that the slide member 4 is moved to the right until the point of the screwdriver 2 has reached the screw head 7*a*. By further movement of the slide member 4 in this direction coupling is effected between the screwdriver 2 and the coupling of the screw drive 1 so that the screwdriver starts to rotate. As the slide member 4 is moved further in the same direction then the screwdriver 2 engages in a cross slot in the screw head 7*a* and turns the screw 7. The screw 7 is then forced through the corresponding opening 14 in the screw belt 13 by retraction of the flaps 15 into the recess 16 of the slide member 14 and is screwed into the workpiece.

On completion of the screwing process the pin 29 effects the uncoupling of the screwdriver 2 in relation to the drive 1.

When the device, including the slide member 4, is removed from the workpiece, the spring 5 returns the slide member 4 to the initial rest position (FIG. 1). The pin 18 engaged during this movement in the part 19 now moves along an arc about the centre point of the coupling disc 17 in a counter-clockwise sense. Since the pawl 27 prevents a corresponding rotational movement of the sprocket disc 10 and thus the sprocket member 9, the projections 21 are released from the corresponding apertures 20 in the sprocket disc 10, as a result of which the coupling disc 17 turns through an indexing step in a counter-clockwise sense and the projections 21 again ratchet in the corresponding apertures 20 and thus the indexing arrangement is prepared for the next working cycle.

I claim:

1. In a device for driving screws, means defining a screw-holding magazine, a casing, a screw-driving member mounted for rotation in the casing, drive means, coupling means for coupling said drive means to the screw-driving member, means for indexing successive screws from the magazine into a screw-driving station in which each successive screw is aligned with the screw-driving member, a slide member slidable in the casing and carrying the indexing means, means operable by exertion of an applied force between the slide member and a workpiece about to receive a screw, to actuate the indexing means and thus index a screw in the magazine to the screw-driving station, to bring the screw-driving member into engagement with the indexed screw and to actuate the drive means to drive the screw by the screw-driving member through the coupling means, and resilient means effective to resist said force exerted between the slide member and the workpiece and to return the device to its initial configuration.

2. A device according to claim 1, wherein the means defining a screw-holding magazine comprises a screw-holding belt, the indexing means comprises a sprocket member, including a sprocket disc, and a coupling including a coupling disc arranged to co-operate with the sprocket disc and carrying a pin, and wherein the casing has a guide slot receiving said pin of the coupling disc whereby movement of the pin in the slot causes the sprocket disc to rotate through one index step.

3. A device according to claim 2, wherein the coupling disc comprises projections and the sprocket disc has recesses arranged, in the coupled condition, to receive the projections of the coupling disc, and wherein the coupling further comprises resilient means operative on reverse motion of the slide member to its initial position to effect rapid release of the coupling by disengagement of the projections from the recesses.

4. A device according to claim 3 comprising means defining stops for limiting arcuate movement of the pin about the axis of the coupling disc.

5. A device according to claim 4, wherein the means defining the stops comprises a plate member rigid with the slide member and having a slot receiving the pin and the ends of which slot form said stops.

6. A device according to claim 2 comprising a pawl mounted on the slide member and co-operating with the sprocket member to permit indexing motion but to prevent motion in the reverse sense.

7. A device according to claim 6, comprising a spring-loaded member providing a bias on the pawl.

8. A device according to claim 1 comprising an adjustable stop member mounted on the casing and engageable by the slide member at the end of the screw-driving operation to disengage the screw-driving member from the drive through the said coupling means.

9. A screw-driving device comprising means defining a screw-holding magazine in the form of an apertured, edgewise notched belt, a casing, a slide member slidable in the casing and carrying, means for indexing successive screws held in the magazine to a station at which the screws can be driven into a workpiece, said indexing means including a sprocket member having sprocket teeth arranged to engage the notches of the magazine belt, a drive coupling, means defined by the casing for controlling the coupling in response to relative sliding motion between the slide member and the casing to index the belt, and means operative on the sprocket member to permit movement thereof in the indexing direction and prevent movement in the opposite sense, a screw-driving member, a drive mounted on the casing and connectable to the screw-driving member to rotate it and drive a screw at the screw-driving station, and resilient means biasing the slide member to an inoperative condition, the device being operated by movement of the slide member relative to the casing from said inoperative condition.

* * * * *